US006273385B1

(12) United States Patent
Hambleton

(10) Patent No.: US 6,273,385 B1
(45) Date of Patent: Aug. 14, 2001

(54) APPARATUS FOR HANGING OBJECTS FROM THE EDGE OF A ROOF ON A BUILDING HAVING A GUTTER

(76) Inventor: John D. Hambleton, 2462 160th Rd., Guthrie Center, IA (US) 50115

( * ) Notice: Subject to any disclaimer, the term of this patent is extended or adjusted under 35 U.S.C. 154(b) by 0 days.

(21) Appl. No.: 09/631,487

(22) Filed: Aug. 3, 2000

(51) Int. Cl.[7] ..... F16B 45/00

(52) U.S. Cl. ..... 248/304; 52/27; 52/49; 248/48.2; 248/340

(58) Field of Search ..... 248/304, 340, 248/48.1, 48.2, 303, 339; 211/105.1, 106.01; 52/27, 94, 11

(56) References Cited

U.S. PATENT DOCUMENTS 2,233,049 * 2/1941 Gray ..... 248/48.1
2,654,555 * 10/1953 Rachlin ..... 248/48.1
3,045,832 * 7/1962 Hibbard .
5,181,683 1/1993 Smith .
5,657,953 8/1997 Smith .
5,737,879 * 4/1998 Sweet ..... 248/48.1 X
5,979,852 11/1999 Levesque .

* cited by examiner

*Primary Examiner*—Ramon O. Ramirez
*Assistant Examiner*—Korie H. Chan
(74) *Attorney, Agent, or Firm*—Henderson & Sturm LLP

(57) ABSTRACT

An apparatus for hanging objects such as bird feeders or planters on the edge of a building of a type having a gutter and drip guard thereon. An elongated member has a first end and a second end and an intermediate portion of the elongated member is operably supported by an upper edge of an outer wall of the gutter. An upwardly extending flange is operably attached to a first end of the elongated member and the upwardly extending flange is disposed between a drip guard and a first wall of the gutter closest to the edge of a roof. A hook is operatively attached to the elongated member at a place spaced from the flange for hanging objects therefrom.

12 Claims, 1 Drawing Sheet

APPARATUS FOR HANGING OBJECTS FROM THE EDGE OF A ROOF ON A BUILDING HAVING A GUTTER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates generally to an apparatus for hanging objects such as bird feeders or planters from the outside of a building, and more particularly to such an apparatus which can be installed with no fasteners between a drip edge of a roof and a gutter.

2. Description of the Related Art

U.S. Pat. No. 5,979,852 to Levesque discloses a bent rod which attaches without fasteners onto the gutter of a building. A problem with such a design is that a portion of the rod extends down into the gutter itself and can operate as a "log jam" to stop leaves and other debris that otherwise would freely flow through the gutter. Additionally, the hanger is directly below the gutter itself, which is not necessarily desirable in all instances.

U.S. Pat. No. 5,181,683 to Smith shows several embodiments of a hanger for hanging objects such as bird feeders from a gutter. This hanger is not necessarily adaptable to all gutter arrangements and there is a need for making a hanger for attachment to a gutter which is cheaper to manufacture.

U.S. Pat. No. 5,657,953 to Smith also shows several embodiments of a hanger for hanging bird feeders or the like, one of which utilizes a portion of a water drainage gutter. This hanger is somewhat complex and is not as universal as may be desirable.

Consequently, there is a need for an apparatus for hanging objects such as bird feeders and planters to the edge of a building which has a gutter which is more economical, easier to install and does not have the drawbacks of the prior art.

BRIEF SUMMARY OF THE INVENTION

The present invention relates to an apparatus for hanging objects such as bird feeders or planters on the edge of a building of a type having a gutter and drip guard thereon. An elongated member has a first end and a second end and an intermediate portion of the elongated member is operably supported by an upper edge of an outer wall of the gutter. An upwardly extending flange is operably attached to a first end of the elongated member and the upwardly extending flange is disposed between a drip guard and a first wall of the gutter closest to the edge of a roof. A hook is operatively attached to the elongated member at a place spaced from the flange for hanging objects therefrom.

An object of the present invention is to provide an improved apparatus for hanging objects from the edge of a roof of a building of a type having a gutter thereon.

Another object of the present invention is to provide an apparatus of the aforementioned type which can be installed without the use of fasteners by disposing a flange between the drip guard and a vertical wall of a drainage gutter.

A further object of the present invention is to provide an apparatus of the aforementioned type which utilizes a straight elongated member so as to hang the object at a distance away from the edge of a drainage gutter, rather than hanging down directly therefrom.

A further object of the present invention is to provide a hanger of the aforementioned type which is versatile enough to be attached to a wall or the like when it is not desired to attach it to a gutter and drip guard.

Other objects, advantages, and novel features of the present invention will become apparent from the following detailed description of the invention when considered in conjunction with the accompanying drawings.

DETAILED DESCRIPTION OF THE INVENTION

Figure 1:
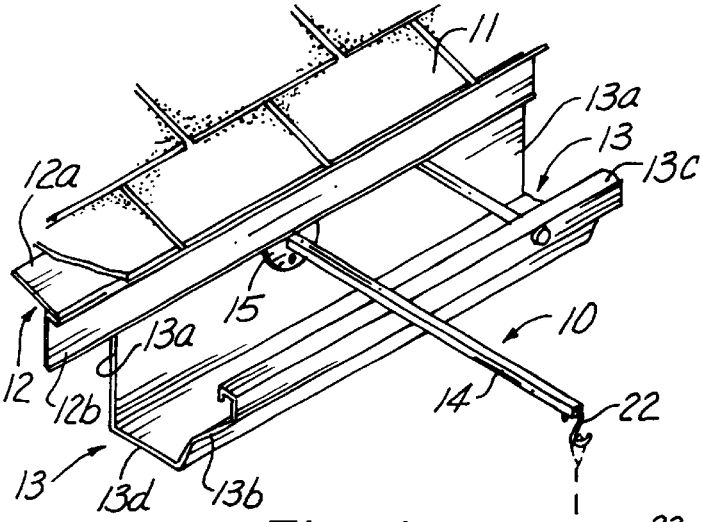
FIG. 1 is a perspective view of a section of a roof of a building having shingles, a style D drip edge or guard and a gutter and having the present invention attached thereto with a bird feeder in dashed lines.
Figure 3:
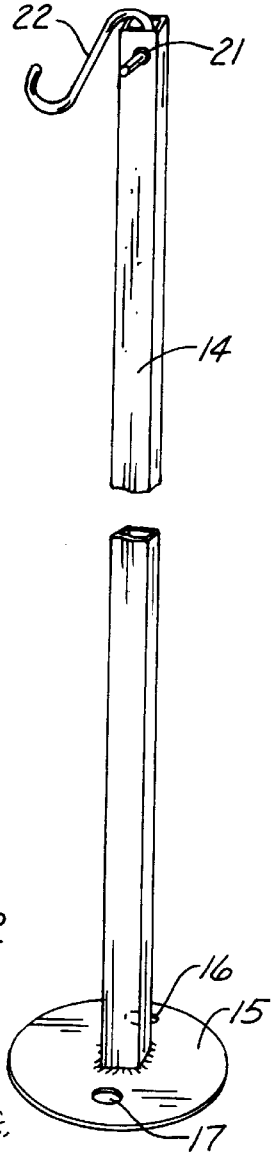
FIG. 3 is a perspective view of the preferred embodiment of the present invention when it is not installed for use.

Referring now to the drawings, wherein like reference numerals designate identical or corresponding parts throughout the several views, FIG. 1 shows the present invention (10) attached to a building having a roof with shingles (11) and a drip guard (12). The drip guard has an upper portion (12*a*) and a lower portion (12*b*). The drip guard (12) shown in is a style D drip guard or drip edge.

A gutter (13) has a first upwardly extending wall (13*a*) and a second upwardly extending wall (13*b*), the second upwardly extending wall having an upper edge (13*c*). A bottom (13*d*) of the gutter (13) provides a base for the upwardly extending walls (13*a*) and (13*b*).

The hanger (10) of the present invention has a straight tubular member (14) which in a preferred embodiment is square in cross section and can be made of steel or aluminum, for example, but of course could even be made of wood or other material such as plastic, if desired. A flange (15) is welded to a first end of the elongated member (14). The flange (15) has a pair of openings (16) and (17) therein which can be utilized to receive fasteners (18) and (19) as shown in FIG. 2 so that it can be mounted to a vertical surface (20).

Figure 2:
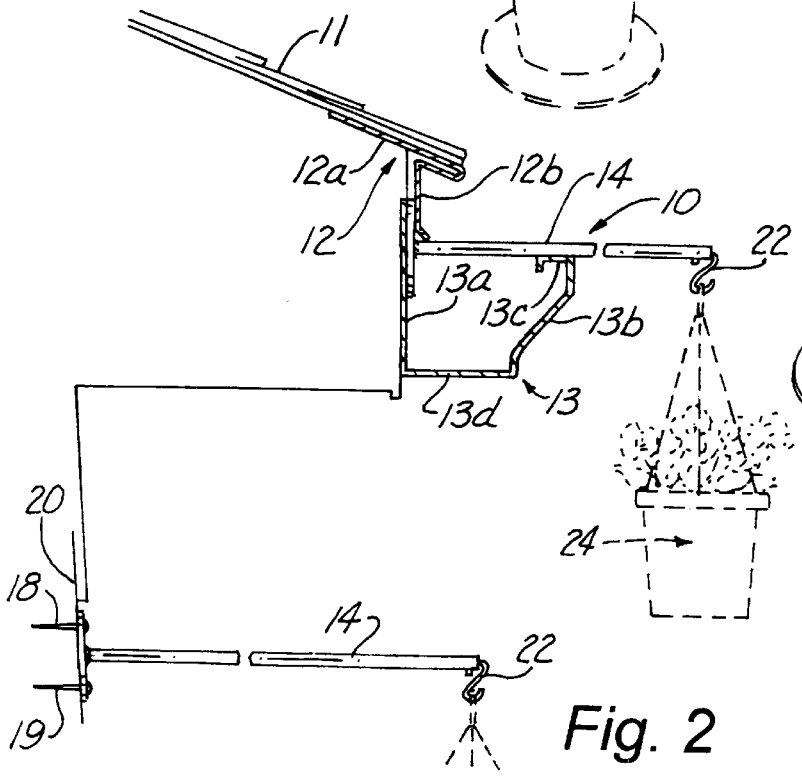
FIG. 2 is a side elevational view of FIG. 1 showing the gutter in cross section and also showing another of the devices of the present invention attached to a wall of the same building, although for illustrative purposes only.

While the openings (16) and (17) make the hanger (10) versatile enough to be mounted in either one of the two positions shown in FIG. 2, the real beauty of the present invention is that it can be installed to the position shown in FIG. 1 without any fasteners whatsoever. The top portion of the flange (15) is merely placed underneath the downwardly extending drip edge (12*b*) as shown in FIG. 1 and in the top portion of FIG. 2 it will stay in this position with another intermediate portion of the elongated member (14) resting on the upper edge (13*c*) of the gutter (13) as can readily be seen in FIGS. 1 and 2. A hole (21) in the second end of the elongated member (14) receives an S-hook (22) which has a hook on each end, of course, so that one end extends through hole (21) and the other end of the hook (22) is available to hang an object (23) such as a bird feeder, as shown in FIG. 1 in dashed lines, or a planter (24), as shown in dashed lines in FIG. 2.

There is an advantage to having the elongated member (14) flat on the bottom side such as is inherent in a square tube; that advantage is that there is no tendency for it to roll along the top edge (13*c*) of the gutter (15).

Accordingly, it will be appreciated that the preferred embodiment does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus comprising:

a building having a roof;

a water drainage gutter disposed along a lower edge of said roof, said gutter having a bottom wall, a first wall extending upwardly from said bottom wall, and a second wall extending upwardly from said bottom wall and having an upper edge;

a drip guard disposed along said lower edge of said roof, said drip guard having a downwardly extending portion extending into said gutter and over a top portion of said first wall of said gutter;

an elongated rod shaped member having a generally rectangular cross-sectional configuration as well as a first end and a second end, a portion of said elongated rod shaped member being operatively supported by said upper edge of said second wall of said gutter;

an upwardly extending flange operatively attached to said first end of said elongated rod shaped member, said upwardly extending flange being disposed between said first wall of said gutter and said downwardly extending portion of said drip guard; and a hook operatively attached to said elongated rod shaped member at a place spaced from said first end for hanging objects therefrom.

2. The apparatus of claim 1 wherein said object is a bird feeder.

3. The apparatus of claim 1 wherein said object is a planter.

4. The apparatus of claim 1 wherein said elongated rod shaped member is straight.

5. The apparatus as in claim 1; wherein said elongated rod shaped member is hollow.

6. The apparatus as in claim 1; wherein said elongated rod shaped member is solid.

7. Apparatus comprising:

a building having a roof;

a water drainage gutter disposed along a lower edge of said roof, said gutter having a bottom wall, a first wall extending upwardly from said bottom wall, and a second wall extending upwardly from said bottom wall and having an upper edge;

a drip guard disposed along said lower edge of said roof, said drip guard having a downwardly extending portion extending into said gutter and over a top portion of said first wall of said gutter;

an elongated rod shaped member having a generally rectangular cross-sectional configuration as well as a first end and a second end, a portion of said elongated rod shaped being operatively supported by said upper edge of said second wall of said gutter;

an upwardly extending flange operatively attached to said first end of said elongated rod shaoed member, said upwardly extending flange being disposed between said first wall of said gutter and said downwardly extending portion of said drip guard; and means for operatively attaching an object from the elongated rod shaped member at a place closer to the second end thereof than to the first end thereof.

8. The apparatus of claim 7 wherein said elongated rod shaped member is straight.

9. The apparatus of claim 7 wherein said flange has an opening therein to permit said elongated rod shaped member to be fastened to a wall.

10. The apparatus of claim 9 wherein said flange also has a downwardly extending portion.

11. The apparatus of claim 10 wherein said downwardly extending portion of said flange has an opening therein for receiving a fastener.

12. The apparatus of claim 7 wherein said means comprises a hook.

* * * * *